United States Patent [19]

Mukai et al.

[11] Patent Number: 5,049,203

[45] Date of Patent: Sep. 17, 1991

[54] METHOD OF MAKING RARE EARTH MAGNETS

[75] Inventors: Toshio Mukai; Tatsuo Fujimoto; Hiroaki Sakamoto, all of Kanagawaken, Japan

[73] Assignee: Nippon Steel Corporation, Tokyo, Japan

[21] Appl. No.: 515,409

[22] Filed: Apr. 27, 1990

[30] Foreign Application Priority Data

Apr. 28, 1989 [JP] Japan ..... 1-107811

[51] Int. Cl.[5] ..... H01F 1/02

[52] U.S. Cl. ..... 148/101; 148/104; 419/12

[58] Field of Search ..... 419/12; 148/101, 104

[56] References Cited

U.S. PATENT DOCUMENTS 4,898,625 2/1990 Otsuka et al. ..... 148/101

FOREIGN PATENT DOCUMENTS 61-81603 4/1986 Japan ..... 419/12

61-81607 4/1986 Japan ..... 419/12

62-102504 5/1987 Japan ..... 148/101

*Primary Examiner*—John P. Sheehan

*Attorney, Agent, or Firm*—Wenderoth, Lind & Ponack

[57] ABSTRACT

A powder X formed by quenching a molten alloy containing, on an atomic percent basis, at least 8%, but less than 13%, of a rare earth component consisting mainly of one or both of neodymium and praseodymium, and 4 to 8% of boron, the balance of its composition being iron and unavoidable impurities, and a powder Y formed by quenching a molten alloy containing, on an atomic percent basis, 13 to 20% of a rare earth component consisting mainly of one or both of neodymium and praseodymium, and 4 to 8% of boron, the balance of its composition being iron and unavoidable impurities, are mixed to prepare a mixture containing 5 to 50% by volume of powder Y. The mixture is subjected to heat and pressure to make a rare earth magnet containing, on an atomic percent basis, 9 to 14% of a rare earth component consisting mainly of one or both of neodymium and praseodymium, and 4 to 8% of boron, the balance of its composition being iron and unavoidable impurities.

5 Claims, 3 Drawing Sheets

METHOD OF MAKING RARE EARTH MAGNETS

BACKGROUND OF THE INVENTION

1. Field of the Invention

This invention relates to a method of making a rare earth magnet having a principal phase composed of a compound represented by the formula $R_2Fe_{14}B$, where R is a rare earth component consisting mainly of one or both of neodymium and praseodymium. The magnets according to this invention are expected to find a wide scope of use in various kinds of actuators including small motors, since they could be inexpensive and yet exhibit a high level of performance.

2. Description of the Prior Art

It is possible to produce a quenched ribbon having excellent magnetic properties if a molten alloy containing a rare earth element (R), iron (Fe), as a typical transition metal element, and boron (B), substantially in the ratio of 2:14:1 is very rapidly quenched by a liquid quenching method employing, for example, a single roll (see Japanese Patent Applications laid open under Nos. 59-64739 and 60-9852). More specifically, a flaky ribbon having a thickness of about 30 microns can be produced if a molten Nd-Fe-B alloy is ejected on the surface of a rotating copper roll. It is known that the ribbon may have an amorphous structure, or a finely crystalline structure with a grain size of 0.01 to 0.5 micron, depending on the cooling rate which is employed. The ribbon exhibits a high intrinsic coercive force when it has a grain size of about 0.05 micron.

A powder obtained by crushing a rapidly quenched ribbon of the Nd-Fe-B alloy can be shaped into a body retaining its excellent magnetic properties and having a density close to that of the alloy. A hot pressed body is slightly magnetically anisotropic, as is taught in Japanese Patent Application laid open under No. 60-10042, which corresponds to U.S. patent application Ser. No. 520,170 filed on Aug. 4, 1983, and as is also reported by R. W. Lee in his paper entitled "Hot-Pressed Neodymium-Iron-Boron Magnets", Applied Physics Letters, Vol. 46, No. 8, Apr. 15, 1985, pp. 790–791. When the powder of the Nd-Fe-B alloy is hot pressed, a plastic flow occurs in the hot pressed body and the resulting rotation of crystals tends to produce the axis of easy magnetization (c-axis) parallel to the direction of pressing. It has been reported that a residual magnetic flux density of about 8 kG is achieved in the direction of pressing.

According to R. W. Lee, a higher residual magnetic flux density can be achieved if a hot pressed product of the Nd-Fe-B alloy having a density close to that of the alloy is subjected to die upsetting to undergo plastic deformation. It has been reported that a residual magnetic flux density of 8 to 13 kG is achieved, depending on the degree of die upsetting and the composition of the alloy (e.g., Y. Nozawa et al., J. Appl. Phys., Vol. 64, No. 10, Nov. 15, 1988, pp. 5285–5289).

Drawbacks, however, exist in a magnet produced as a hot pressed product of the powder prepared from a rapidly quenched ribbon of the Nd-Fe-B alloy, as will hereinafter be pointed out.

The anisotropic sintered magnets of a samarium-cobalt alloy ($SmCo_5$ or $Sm_2Co_{17}$) which are reliably used in small motors, etc. exhibit a residual magnetic flux density of 8.5 to 10.5 kG. As samarium is expensive, however, these magnets are partly being replaced by sintered magnets of the Nd-Fe-B alloy, since neodymium is less expensive. No magnet obtained as a hot pressed product of the powder prepared from a rapidly quenched ribbon of the Nd-Fe-B alloy can, however, be a satisfactory substitute for any sintered Sm-Co magnet, since it exhibits a residual magnetic flux density of only about 8 kG, as hereinabove stated. A hot pressed and die upset product can be a good substitute, as far as its magnetic properties are concerned, but the addition of the die upsetting process presents other problems. The die upsetting process not only adds to the time and labor which are required for producing a magnet, but also renders it difficult to make a product of the desired shape. Accordingly, it cannot necessarily be said to be less expensive than a sintered Sm—Co magnet, though neodymium itself is less expensive. For making an inexpensive rare earth magnet, therefore, it is desirable to employ a method which enables mass production and also eliminates the necessity for any final cutting or grinding process, or the so-called "near-net shaping" process.

SUMMARY OF THE INVENTION

Under these circumstances, it is an object of this invention to provide a method which can make a magnet exhibiting a residual magnetic flux density of at least 8.5 kG by hot pressing a powder prepared from a rapidly quenched rare earth-iron-boron alloy and showing a high saturation magnetization, and without involving any necessity for the upsetting of a hot pressed product.

This object is attained by a method of making a rare earth magnet containing, on an atomic percent basis, 9 to 14% of a rare earth component consisting mainly of one or both of neodymium and praseodymium, and 4 to 8% of boron, the balance of its composition being iron and unavoidable impurities, which comprises mixing a powder X formed by quenching a molten alloy containing, on an atomic percent basis, at least 8%, but less than 13%, of a rare earth component consisting mainly of one or both of neodymium and praseodymium, and 4 to 8% of boron, the balance of its composition being iron and unavoidable impurities, and a powder Y formed by quenching a molten alloy containing, on an atomic percent basis, 13 to 20% of a rare earth component consisting mainly of one or both of neodymium and praseodymium, and 4 to 8% of boron, the balance of its composition being iron and unavoidable impurities, to prepare a mixture containing 5 to 50% by volume of the powder Y, and hot pressing the mixture.

The magnet may further contain cobalt in such a proportion as to substitute not more than 20% of iron. The mixture is preferably heated electrically when it is hot pressed, as electrical heating enables a higher level of productivity.

This invention enables the economical manufacture of magnets, since the neodymium of which their rare earth component mainly consists is inexpensive. Moreover, the magnet according to this invention acquires a shape conforming exactly to the contour of the cavity of a hot pressing die which defines the desired finished shape of the magnet, and does, therefore, not call for any postworking, such as grinding. This is an economical advantage of the magnet according to this invention over any Nd-Fe-B magnet produced by sintering at normal pressure, as the latter requires some postworking or other to acquire the desired shape.

Other features and advantages of this invention will become apparent from the following description and the accompanying drawings.

BRIEF DESCRIPTION OF THE DRAWINGS

FIG. 2(*b*) is a photograph similar to FIG. 2(*a*), but showing the microstructure of a high-density magnet formed from a mixture comprising 80% of powder X and 20% of powder Y.

DETAILED DESCRIPTION OF THE INVENTION

It is known that the magnetic properties of a ribbon formed by cooling a neodymium-iron-boron alloy rapidly depend largely upon the proportion of neodymium which it contains. More specifically, an increase of neodymium from its proportion (11.8%) in the compound having the formula $Nd_2Fe_{14}B$ brings about a higher intrinsic coercive force (iHc), but a lower residual magnetic flux density (Br).

We, the inventors of this invention, prepared ribbons of alloys containing different proportions of neodymium, as shown below, crushed each ribbon into a powder having a particle size not exceeding 150 microns, and formed a resin-bonded magnet having a density of 6.0 g/cm$^3$ from the powder. We studied the magnetic properties of the magnets and obtained the results as shown below:

Fe-12% Nd-6% B: iHc=9.9kOe, $B_r$=7.0 kG;

Fe-15% Nd-6% B: iHc=19.1 kOe, $B_r$=5.9 kG;

The alloy containing 12% Nd ought to exhibit a $B_r$ value of 8.8 kG in view of its density of 7.5 g/cm$^3$. It, therefore, follows that, if the powder of this alloy can be shaped into a solid body having a density close to this density, while retaining its magnetic properties, it is possible to produce a magnet exhibiting a $B_r$ value of 8.8 kG. Our experiments have, however, shown that a temperature which is as high as nearly 800° C. must be employed for compacting the powder of the alloy containing 12% Nd into a solid body having a density close to that of the alloy, and that the use of such a high temperature results in a great lowering of intrinsic coercive force which in turn brings about a lowering of residual magnetic flux density to a level not exceeding 8.5 kG. We have found that, on the other hand, the powder of the alloy containing 15% Nd can be consolidated easily at a temperature of 650° C. to 700° C. and forms a solid body retaining a high intrinsic coercive force.

Figure 1:
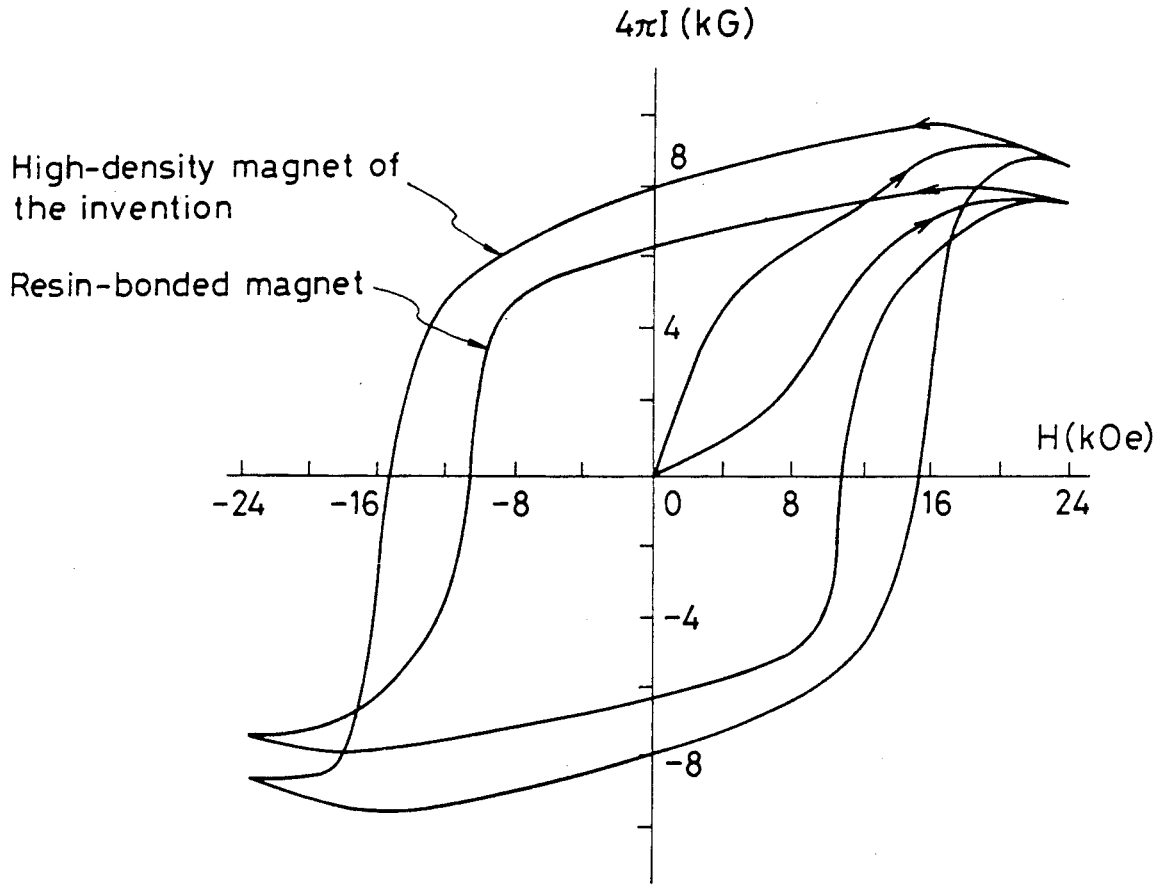
FIG. 1 is a chart showing the magnetization curves of a high-density magnet according to this invention and a resin-bonded magnet.

According to a salient feature of this invention, therefore, the powder of an alloy containing a high proportion of neodymium (hereinafter referred to as the high neodymium powder) is added to the powder of an alloy containing a low proportion of neodymium (low neodymium powder) and the mixture thereof is compacted under heat. The high neodymium powder is used to assist the consolidation of the low neodymium powder and can, therefore, be said to serve as a binder for the latter. We have discovered as a new fact that the addition of the powder serving as a binder enables the manufacture of a product exhibiting a greatly improved intrinsic coercive force. For example, we have been able to make a magnet having a intrinsic coercive force as high as 15.3 kOe by compacting under heat a mixture comprising the powder of an alloy containing 12% Nd and the powder of an alloy containing 15% Nd in the ratio of 4 to 1 to a high-density equal to at least 95% of that of the material, as will become more apparent from EXAMPLE 1 which will hereinafter be described, while a magnet made by binding the same mixture with a resin has exhibited a intrinsic coercive force of only 10.8 kOe. The magnetization curves of the two magnets are shown in FIG. 1. As is obvious therefrom, the two magnets follow different processes of magnetization, and the high-density magnet according to this invention can be said to be a novel type of magnet differing from the resin-bonded magnet which is a product of the mere aggregation of the two alloy powders.

The high-density magnet according to this invention has a composite structure formed by two types of masses of crystal grains containing different proportions of neodymium. This structure is shown by way of example in FIG. 2(*b*). The masses X of crystal grains containing a low proportion of neodymium and the masses Y of crystal grains containing a high proportion of neodymium are clearly distinguishable from each other in FIG. 2(*b*), though a detailed discussion will be made in the description of EXAMPLE 1. The high-density magnet according to this invention owes its high intrinsic coercive force to its composite structure. The percentage by volume of the masses Y in the magnet is easy to calculate if the percentage which the total area of the masses Y occupies in a photograph, such as FIG. 2(*b*), is determined.

Thus, the use of a high neodymium alloy powder as a binder enables the effective consolidation of a low neodymium alloy powder exhibiting a high residual magnetic flux density, and the achievement of a high intrinsic coercive force. A residual magnetic flux density of at least 8.5 kG can be achieved if the composition and proportion of the alloy powder used as a binder are appropriately selected.

The rare earth magnet according to this invention is made by the hot compaction of a mixture of two alloy powders X and Y having different compositions. Neodymium is the most preferable element that can be used as the rare earth component R of each alloy. The rare earth component R may, however, consist of praseodymium, or both neodymium and praseodymium. The component R may further contain one or more additional elements selected from yttrium, lanthanum, cerium, samarium, gadolinium, terbium, dysprosium and holmium if the total proportion of the additional element or elements does not exceed 20% of the total proportion of neodymium and/or praseodymium.

The proportion of R in the powder X is in the vicinity of, or below, 11.8%, i.e. the proportion of R in the phase of the formula $R_2Fe_{14}B$, so that the powder X may exhibit a high residual magnetic flux density. More specifically, the powder X contains at least 8%, but less than 13%, of rare earth component R. If the proportion of R is less than 8%, the powder X exhibits only a very low intrinsic coercive force, resulting in a practically unacceptable magnet. If it is increased to 13% or above, the powder X exhibits an undesirably low residual magnetic flux density.

The powder X having the composition as specified above is difficult to form into a solid body, and calls for the assistance of an appropriate binder. According to this invention, the powder Y serves as a binder for the powder X. The powder Y must be such that the alloy comprises an R-rich phase (i.e. a phase containing a high proportion of rare earth component) which is slightly eluated when the powder mixture is hot worked, as the R-rich phase which has been eluated functions as a binder. Therefore, the powder Y contains 13 to 20% of rare earth component R. If the proportion of R exceeds 20%, the powder Y exhibits only a very low residual magnetic flux density, resulting in a high-density magnet exhibiting undesirably low magnetic properties. The magnet acquires a composite structure formed by two types of masses of crystal grains which are substantially identical in composition to the powders X and Y, respectively, since the hot compaction of the powder mixture is rapidly accomplished at a low temperature.

The mixture of the powders X and Y is so prepared as to contain 5 to 50% by volume of powder Y. If it contains only less than 5% by volume of powder Y, the mixture not only is difficult to densify, but also fails to attain a satisfactorily high intrinsic coercive force. If the powder Y occupies more than 50% by volume, the proportion of powder X is too small to ensure the manufacture of a magnet having a high residual magnetic flux density. The proportions of the two powders as hereinabove set forth are essential to ensure the manufacture of a magnet containing 9 to 14% of rare earth component R on an atomic percent basis. No magnet containing less than 9% of rare earth component R exhibits a satisfactorily high intrinsic coercive force, while no magnet containing more than 14% thereof exhibits a high residual magnetic flux density.

Both of powders X and Y contain 4 to 8% of boron on an atomic percent basis. If the proportion of boron is less than 4%, a phase of $R_2Fe_{17}$ appears, and if it exceeds 8%, a boron-rich phase is formed. Both of these phases prevent the satisfactory densification of the powder when it is compacted. Therefore, the magnet according to this invention contains 4 to 8% of boron.

Cobalt is sometimes used to replace a part of iron in an alloy to raise its Curie temperature and thereby limit the temperature dependence of its magnetic flux density. The magnet according to this invention can also contain cobalt without lowering its magnetic properties if it replaces not more than 20% of iron. The magnet may also contain one or more additional elements selected from aluminum, silicon, nickel, copper, zinc, gallium, titanium, zirconium and hafnium to improve its intrinsic coercive force if it or they replace not more than 5% of iron.

The method of this invention will now be described in further detail. The ribbon from which each of powders X and Y is prepared can be formed in a number of ways. Although the single-roll process is the most reliable of all, it is also possible to use the double-roll process or the gas atomizing process. The single-roll process enables the formation of a thin flaky ribbon having a thickness of 20 to 30 microns, a width of 1.5 to 2 mm and a length of 10 to 20 mm. The magnetic properties of a ribbon prepared by the single-roll process depend on the rate of cooling which in turn depends on the rotating speed of the roll. The optimum rate of cooling yields a ribbon composed of fine crystal grains having a size of 0.01 to 0.1 micron, and exhibiting excellent magnetic properties. Overquenching yields a ribbon having a nearly amorphous structure, but it can be converted by heat treatment to a crystalline structure exhibiting high magnetic properties. In either event, the ribbon is crushed to form a powder. The powder preferably has a particle diameter of about 100 microns. The two powders which are employed for the purpose of this invention are easy to mix by, for example, a V-type mixer.

The hot working of the powder mixture may be carried out at a temperature of 550° C. to 850° C. and a pressure of 0.1 to 5 tons/cm$^2$. If the temperature is lower than 550° C., the mixture fails to form a highly densified body, and if it exceeds 850° C., the coarsening of the crystal grains results in a product having poor magnetic properties. The hot working is easy to carry out by an ordinary hot press of the high-frequency induction heating type. A higher level of productivity can, however, be achieved if an electric sintering machine is used to heat the mixture directly by passing an electric current through it. This way of heating is so rapid that the desired working of the mixture can be accomplished within as short a time as between one and five minutes. The rapid electrical heating is also beneficial to restrain any substantial lowering in the intrinsic coercive force of the material.

The invention will now be described more specifically with reference to a few examples.

EXAMPLE 1

A powder X was prepared from an alloy containing iron, 12% of neodymium, 5% of cobalt and 6% of boron on an atomic percent basis, and a powder Y from an alloy containing iron, 15% of neodymium and 6% of boron on the same basis, by the process as will hereunder be described. Each alloy was melted by high-frequency induction heating and the molten alloy was ejected onto the peripheral surface of a rotating copper roll through a quartz nozzle having an orifice diameter of 1 mm. The roll was rotated at a surface velocity of 25 meters per second which was considered as providing the optimum cooling condition for the formation of fine crystal grains. A ribbon having a thickness of 20 to 30 microns, a width of about 1.5 mm and a length of 10 to 20 mm was obtained. It was crushed into particles having a size not exceeding 150 microns, whereby the two powders X and Y were prepared.

Each powder was mixed with 3% by weight of an epoxy resin and the mixture was pressed to form a bonded magnet. It had a density of 6.0 g/cm$^3$. Each magnet was magnetized in a pulsed magnetic field having a strength of 60 kOe and its magnetic properties were determined by an automatic fluxmeter. The following results were obtained:

Powder X: iHc=10.6 kOe, $B_r$=7.0 kG,
$(BH)_{max}$=11.0 MGOe;
Powder Y: iHc=19.1 kOe, $B_r$=5.9 kG,
$(BH)_{max}$=7.9 MGOe;

Different proportions of powders X and Y were mixed to prepare mixtures having different compositions. Each mixture was hot compacted in an electric sintering machine. This was carried out by placing the mixture in the cavity of a carbon die and heating it electrically, while applying a pressure of 400 kg/cm$^2$ to it. The cavity was cylindrical and had a diameter of 20 mm. The mixture showed a density of 7.6 g/cm$^3$, close to the full density of the powder X when compacted at a temperature of 650° C. to 800° C., depending on the proportions of the two powders.

FIG. 1 shows the magnetization curve of a high-density magnet made by the electric sintering of the mixture containing 20% by volume of powder Y, and having a density of 7.6 g/cm$^3$. For the sake of comparison, it also shows the magnetization curve of a resin-bonded magnet made from the mixture containing the same proportion of powder Y, and having a density of 6.0 g/cm$^3$. As is obvious from FIG. 1, the high-density magnet according to this invention followed an entirely different process of magnetization from that of the resin-bonded magnet.

Figure 2A:
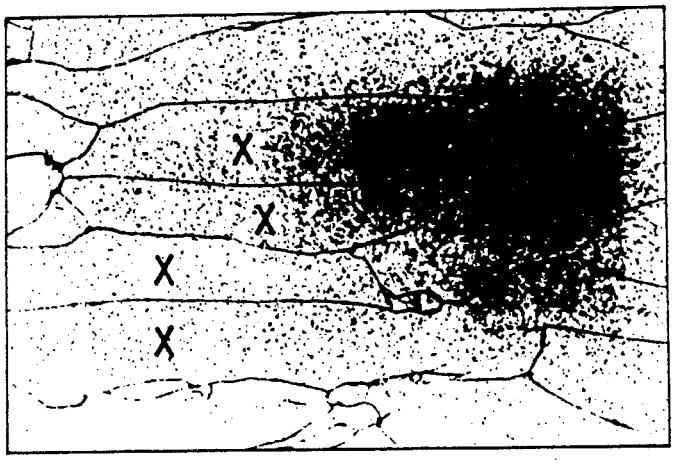
FIG. 2(*a*) is a photograph taken through an optical microscope and showing the microstructure of a high-density magnet formed solely from a powder X.
Figure 2B:
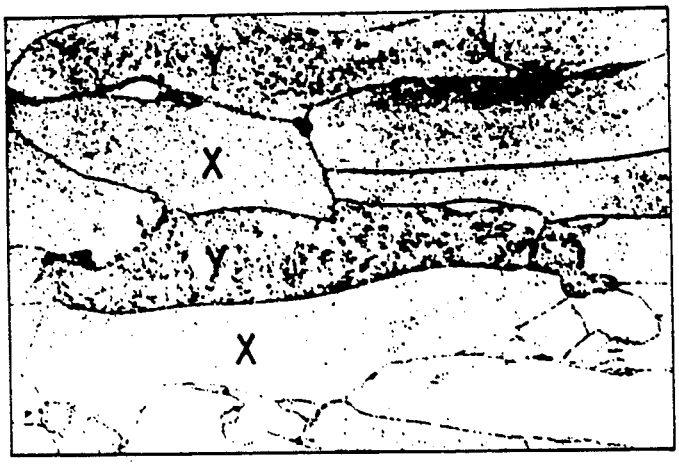

Reference is now made to FIG. 2(*a*) showing the microstructure of a high-density magnet made by consolidating the powder X alone, and FIG. 2(*b*) showing the microstructure of a high-density magnet made by consolidating the mixture comprising 80% of powder X and 20% of powder Y. These structures were observed through an optical microscope after etching by a 1% nital solution. As is obvious from FIG. 2(*b*), the etched structure revealed clearly distinguishable regions of the high neodymium powder Y (masses Y of crystal grains).

Figure 3:
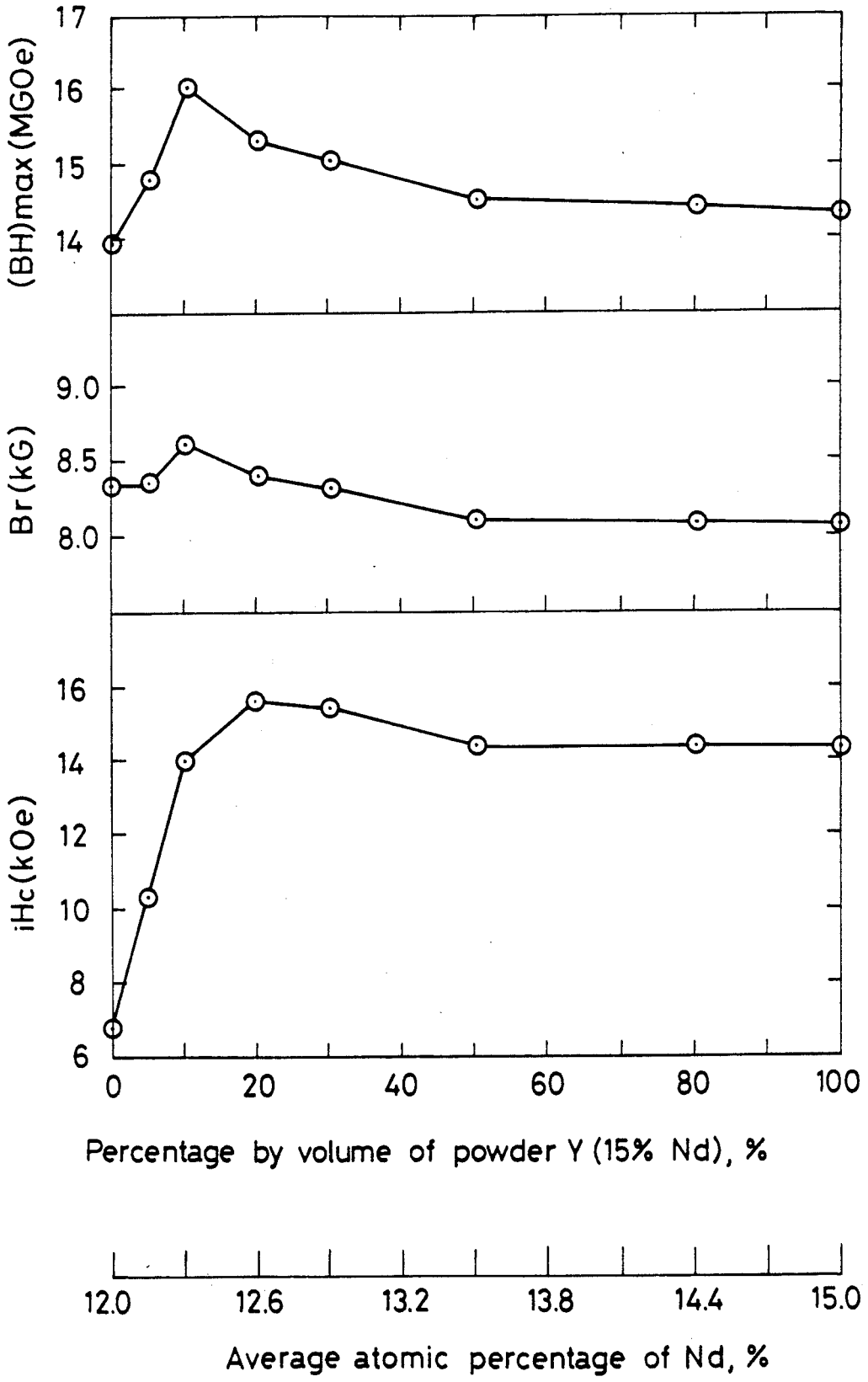
FIG. 3 is a chart showing the magnetic properties of high-density magnets in relation to the percentage by volume of powder Y (containing 15% of neodymium) in the powder mixture employed for making the magnets, and the average atomic percentage of neodymium determined by calculation therefrom as being present in the magnets.

Attention is now drawn to FIG. 3 showing the magentic properties of high-density magnets made from the mixtures containing different proportions by volume of powder Y, as determined in the direction of application of pressure. The magnetic properties of each material were determined by an automatic fluxmeter after it had been magnetized in a pulsed magnetic field having a strength of 60 kOe. As is obvious from FIG. 3, the use of 10 to 30% by volume of powder Y as a binder brought about a greatly improved intrinsic coercive force (iHc). The magnet containing 10% by volume of powder Y exhibited a residual magnetic flux density ($B_r$) of 8.6 kG which was higher than that of any other magnet. No high residual magnetic flux density could be achieved when the mixture contained more than 50% by volume of powder Y. As a consequence, the magnet containing 10% by volume of powder Y exhibited a maximum energy product, $(BH)_{max}$ of 16.0 MGOe which was higher than that of any other magnet.

EXAMPLE 2

Another experiment was conducted by employing the powders X and Y (containing 12% and 15%, respectively, of neodymium) which had been prepared in EXAMPLE 1. The experiment was carried out by hot pressing a mixture comprising 90% by volume of powder X and 10% by volume of powder Y, as well as powder X alone.

Prior to hot pressing, however, each material (mixture or powder X) was cold worked under pressure to form a compacted body which was slightly smaller than the cavity of a die in the hot press in order to undergo a higher degree of plastic deformation. The body was cylindrical and had a diameter of 20 mm.

The compacted body was placed in the cylindrical die cavity having a diameter of 22 mm and was heated at a temperature of 740° C. under a pressure of 1 ton/cm$^2$. The hot pressing was continued for a period of 10 minutes including the time for raising the temperature of the material to 740° C. Cylindrical products having a diameter of 22 mm were obtained. They had a density of 7.6 g/cm$^3$ close to the full density of the alloy.

The magnetic properties of the two products which had been obtained were determined, and are shown in TABLE 1 below. As is obvious from it, the product of the mixture containing 10% of powder Y exhibited great improvements in both intrinsic coercive force and residual magnetic flux density over the product of powder X alone. The higher levels of residual magnetic flux density which were obtained in this example were due to the preliminary cold working which had caused a higher degree of plastic deformation than what had occurred in EXAMPLE 1.

TABLE 1

| Material | iHc (kOe) | $B_r$ (kG) | $(BH)_{max}$ (MGOe) |
|---|---|---|---|
| X alone | 7.5 | 8.4 | 14.6 |
| X (90%) + Y (10%) | 13.8 | 9.2 | 18.6 |

EXAMPLE 3

The same cooling process as had been employed in EXAMPLE 1 was employed for preparing powders having different compositions as shown below on an atomic percent basis:

X1: Fe—10% Nd—6% B;
X2: Fe—11% Nd—6% B;
X3: Fe—12% Nd—5% Co—6% B;
Y1: Fe—15% Nd—6% B;
Y2: Fe—16% Nd—6% B;
Y3: Fe—17% Nd—1.5% Cu—5% B;
Y4: Fe—16% Pr—1.8% Cu—5% B.

An experiment was first made by consolidating a mixture comprising 80% by volume of powder X1 and 20% by volume of powder Y1, and also powder X2 alone. It will be noted that the mixture of X1 and Y1 had an average proportion of neodymium coinciding with that of X2 alone.

Other experiments were made by consolidating mixtures of powder X3 with 10% by volume of different powders Y2, Y3 and Y4 each serving as a binder. All of the experiments were conducted by employing a hot press under the same conditions as in EXAMPLE 2.

The magnetic properties of each hot pressed product were determined, and are shown in TABLE 2 below. The product of powder X2 alone showed low magnetic properties, as the powder had not been satisfactorily densified by hot pressing. On the other hand, all of the products of the mixtures exhibited high magnetic properties.

TABLE 2

| Material | iHc (kOe) | $B_r$ (kG) | $(BH)_{max}$ (MGOe) |
|---|---|---|---|
| X2 alone | 4.8 | 7.1 | 7.8 |
| X1 (80%) + Y1 (20%) | 12.0 | 8.5 | 14.9 |
| X3 (90%) + Y2 (10%) | 15.0 | 8.8 | 16.8 |
| X3 (90%) + Y3 (10%) | 15.8 | 8.8 | 16.8 |
| X3 (90%) + Y4 (10%) | 15.9 | 8.5 | 15.6 |

What is claimed is:

1. A method of making a rare earth magnet containing, on an atomic percent basis, 9 to 14% of a rare earth component consisting mainly of at least one of neodymium and praseodymium, and 4 to 8% of boron, the balance of its composition consisting essentially of iron and unavoidable impurities, which comprises:

mixing a powder X formed by quenching a molten alloy containing, on an atomic percent basis, at least 8% but less than 13%, of a rare earth component consisting mainly of at least one of neodymium and praseodymium, and 4 to 8% of boron, the balance of its composition consisting essentially of iron and unavoidable impurities, and a powder Y formed by quenching a molten alloy containing, on an atomic percent basis, 13 to 20% of a rare earth component consisting mainly of at least one of neodymium and praseodymium, and 4 to 8% of boron, the balance of its composition consisting essentially of iron and unavoidable impurities, to prepare a mixture containing 5 to 50% by volume of said powder Y; and pressing said mixture at a temperature of 550° C. to 850° C. under a pressure of 0.1 to 5 tons/cm$^2$.

2. A method as set forth in claim 1, wherein said mixture further contains cobalt in such a proportion as to replace not more than 20% of said iron.

3. A method as set forth in claim 2, wherein said temperature of 550° C. to 850° C. is electrically supplied.

4. A method as set forth in claim 1, wherein said temperature of 550° C. to 850° C. is electrically supplied.

5. A method as set forth in claim 1, wherein each of said powders X and Y has a particle diameter of from about 100 microns to 150 microns.

* * * * *